US009057347B2

(12) United States Patent
Veit et al.

(10) Patent No.: US 9,057,347 B2
(45) Date of Patent: Jun. 16, 2015

(54) METHOD FOR DETERMINING A CHARACTERISTIC FOR A PRESSURE REGULATING VALVE

(75) Inventors: Guenter Veit, Plochingen (DE); Marc Oliver Roehner, Heidelberg (DE); Markus Viereck, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 278 days.

(21) Appl. No.: 13/810,365

(22) PCT Filed: Jun. 27, 2011

(86) PCT No.: PCT/EP2011/060705

§ 371 (c)(1), (2), (4) Date: Mar. 29, 2013

(87) PCT Pub. No.: WO2012/010383

PCT Pub. Date: Jan. 26, 2012

(65) Prior Publication Data

US 2013/0180597 A1 Jul. 18, 2013

(30) Foreign Application Priority Data

Jul. 20, 2010 (DE) ..... 10 2010 031 570

(51) Int. Cl.
*F02M 47/02* (2006.01)
*F02D 41/22* (2006.01)
(Continued)

(52) U.S. Cl.
CPC ..... *F02M 47/02* (2013.01); *F02M 47/027* (2013.01); *F02D 41/023* (2013.01); *F02D 41/042* (2013.01); *F02D 41/123* (2013.01); *F02D 41/221* (2013.01); *F02D 41/222* (2013.01);
(Continued)

(58) Field of Classification Search
CPC ... F02M 47/02; F02M 47/027; F02D 41/3863
USPC ..... 701/104, 112, 113, 102, 101; 123/457, 123/458, 459, 462, 463, 506, 510, 511, 512, 123/514; 137/14, 505
See application file for complete search history.

(56) References Cited

U.S. PATENT DOCUMENTS 4,619,238 A 10/1986 Hain et al.
8,276,566 B2 10/2012 Horstmann et al.
(Continued)

FOREIGN PATENT DOCUMENTS

CN 101737185 6/2010
DE 34 10 146 10/1985
(Continued)

OTHER PUBLICATIONS

International Search Report, dated Jan. 3, 2012, issued in corresponding PCT/EP2011/060705.

*Primary Examiner* — Mahmoud Gimie
(74) *Attorney, Agent, or Firm* — Kenyon & Kenyon LLP

(57) ABSTRACT

A method for determining a characteristic for a pressure regulating valve of an injection system is described, using which fuel is injected into an internal combustion engine, in which a flow of the fuel which flows through the pressure regulating valve is set to a minimum and a control pressure of the fuel is reduced until the pressure regulating valve is opened, and in which at least one value for the characteristic is formed from a difference between a value for the control pressure, at which the pressure regulating valve opens, and a reference value for the control pressure.

10 Claims, 2 Drawing Sheets

(51) Int. Cl.

| | |
|---|---|
| ***F02D 41/24*** | (2006.01) |
| *F02D 41/38* | (2006.01) |
| *F02D 41/02* | (2006.01) |
| *F02D 41/04* | (2006.01) |
| *F02D 41/12* | (2006.01) |
| *F02D 41/20* | (2006.01) |

(52) U.S. Cl.
CPC ..... *F02D 41/2438* (2013.01); *F02D 41/2464* (2013.01); *F02D 41/3845* (2013.01); *F02D 41/3863* (2013.01); *F02D 2041/2065* (2013.01); *F02D 2041/223* (2013.01); *F02D 2041/224* (2013.01); *F02D 2200/0602* (2013.01); *F02D 2200/0614* (2013.01)

(56) References Cited

U.S. PATENT DOCUMENTS

| | | | | |
|---|---|---|---|---|
| 8,583,347 | B2 * | 11/2013 | Veit et al. | 701/103 |
| 2004/0016421 | A1 | 1/2004 | Mattes | |
| 2005/0115533 | A1 | 6/2005 | Okamoto et al. | |
| 2008/0257314 | A1 | 10/2008 | Veit et al. | |
| 2010/0307459 | A1 * | 12/2010 | Steinbach et al. | 123/511 |
| 2010/0307460 | A1 * | 12/2010 | Matsuki et al. | 123/511 |
| 2011/0022290 | A1 * | 1/2011 | Kaneko et al. | 701/103 |
| 2011/0093183 | A1 * | 4/2011 | Veit et al. | 701/103 |

FOREIGN PATENT DOCUMENTS

| | | |
|---|---|---|
| DE | 100 16 900 | 11/2001 |
| DE | 101 31 507 | 1/2003 |
| DE | 102 61 446 | 7/2004 |
| DE | 10 2004 006 694 | 8/2005 |
| DE | 10 2004 032 178 | 1/2006 |
| DE | 10 2004 049 812 | 4/2006 |
| DE | 10 2004 059 330 | 6/2006 |
| DE | 10 2005 058 966 | 8/2007 |
| DE | 10 2006 018 164 | 8/2007 |
| DE | 10 2009 045 563 | 4/2011 |
| WO | WO 2004/061285 | 7/2004 |

* cited by examiner

METHOD FOR DETERMINING A CHARACTERISTIC FOR A PRESSURE REGULATING VALVE

CROSS REFERENCE TO RELATED APPLICATIONS

The present application is the national stage entry of International Patent Application No. PCT/EP2011/060705, filed on Jun. 27, 2011, which claims priority to Application No. DE 10 2010 031 570.2, filed in the Federal Republic of Germany on Jul. 20, 2010.

FIELD OF INVENTION

The present invention relates to a method and a system for determining a characteristic for a pressure regulating valve.

BACKGROUND INFORMATION

Accumulator injection systems for internal combustion engines, which are also referred to as common rail injection systems, typically have two final control elements to regulate operating parameters of a fuel to be injected. The metering unit is provided as the first final control element, using which a quantity regulation of the fuel takes place. Pressure regulation of the fuel takes place using the pressure regulating valve as the second final control element.

During a pressure regulating operation, the pressure regulating valve is operated by being solely controlled via the metering unit. A control of the pressure regulating valve is designed in the case of the pressure regulating operation in such a way that the pressure regulating valve remains closed with all relevant tolerance sources being taken into account.

If this is not ensured, a permanent leak may result at the pressure regulating valve, due to which impermissible heating of the injection system and/or fuel as well as an increase in the fuel consumption may result. The leak may be detected by monitoring functions and a limp-home operation may be initiated thereupon.

On the other hand, a required tolerance allowance at the pressure regulating valve may have the result that injection systems are operated using an excessively high opening pressure at the pressure regulating valve depending on the position tolerance. However, in case of an error, for example, a metering unit which is stuck open, this may prove to be disadvantageous, because pressures far above the nominal pressure or setpoint pressure may thus result as a possible reference value for the control pressure of the injection system. The increased pressures arising in such a case of error must not result in a failure of the injection system.

Excessively high pressures may cause ruptures of lines of the injection system and therefore an escape of fuel into the engine compartment. Furthermore, the durability of components in the injection system may be reduced, since their failure may be induced. In addition, a loss of the limp-home capability may occur, using which a vehicle is typically moved out of a danger zone.

In consideration of a typical error detection and response time, it is necessary under these given conditions to design components of the injection system to be appropriately complex and robust.

Furthermore, so-called adaptation functions for determining a characteristic of the pressure regulating valve are provided for a pressure regulating valve, such a characteristic typically being a characteristic curve of the pressure regulating valve.

In these adaptation functions for a pressure regulating valve which is capable of adaptation and/or learning, learning only takes place during pressure-regulated operation. The adaptation takes place in the event of nearly arbitrary and thus only slightly controllable boundary conditions of the pressure and a flow rate of the fuel through the pressure regulating valve. A flow rate through the pressure regulating valve to be provided for the adaptation is substantially greater than 0 L/h, whereby a tolerance definition for the opening pressure of the pressure regulating valve worsens. The highest pressure at which learning may take place using these adaptation functions is much less than a pressure limit of the injection system. Proceeding from a learned pressure, the tolerance definition worsens with increasing distance therefrom.

These adaptation functions offer the possibility of reducing the flow rate during the adaptation proceeding from the quantity of fuel which results from a full delivery of the pump. However, further tolerance sources arise in this way, which may worsen an overall result of the adaptation.

German Application No. DE 10 2004 006 694 A1 describes, inter alia, a method for operating an internal combustion engine having an injection system, in particular for a motor vehicle. In the injection system, fuel is conveyed by a metering unit and a high-pressure pump into a fuel accumulator. The pressure in the fuel accumulator is registered and regulated by the control unit by activating the metering unit. In this system, in order to also take into consideration possible manufacturing tolerances of individual metering units in the regulation of the pressure in the fuel accumulator and to make the regulation more precise in this way, it is proposed that an individual characteristic curve be ascertained for the particular instantaneously used metering unit and be taken into consideration in the pressure regulation. Therefore, an individual characteristic curve, typically for a pump, is learned using the described method.

In a fuel system for an internal combustion engine described in German Application No. DE 10 2004 059 330 A1, the fuel is conveyed by a high-pressure fuel pump into the fuel pressure accumulator, from which the fuel reaches at least one combustion chamber of the internal combustion engine via at least one injector. A value for the actual pressure in the fuel pressure accumulator is provided. A pressure regulating unit, using which fuel may be discharged from the fuel pressure accumulator, is pilot controlled using a pilot control signal, which is ascertained in consideration of a setpoint pressure in the fuel pressure accumulator. It is proposed that a value for a fuel quantity flowing through the pressure regulating unit be taken into consideration upon the ascertainment of the pilot control signal. A consideration of a flow rate through a pressure regulating valve as the foundation for the mentioned adaptation functions is therefore described here.

A method for operating a fuel injection system, in particular for a motor vehicle, is described in German Application No. DE 10 2004 049 812 A1. The fuel injection system has a fuel accumulator, to which fuel may be supplied via a metering unit. In the method, an actual pressure in the fuel accumulator is influenced, inter alia, by a current regulator. A pilot control value is generated by a pilot control characteristic map, using which production-related deviations of components of the fuel injection system are compensated for. Therefore, an adaptation method based on a characteristic map to compensate for manufacturing tolerances in the case of regulation via the metering unit is described here. This method may also be used for the mentioned adaptation functions due to the use of an integral control element.

German Application No. DE 10 2006 018 164 B3 describes a method and a device for controlling an injection system for an internal combustion engine having a high-pressure pump for conveying fuel into a fuel accumulator, to which an injector is hydraulically coupled. In addition, the injection system includes a volume flow control valve, using which a fuel volume flow through the volume flow control valve into the high-pressure pump is settable, and a pressure control valve. In the method, the pressure control valve is set to a fuel volume flow through the pressure control valve equal to zero. A first control value for the volume flow control valve is determined as a function of a fuel volume flow setpoint value through the volume flow control valve. A deviation of the control value for the volume flow control valve is ascertained as a function of a difference between a setpoint value and an actual value of a pressure in the fuel accumulator. A second control value for the volume flow control valve is determined as a function of a reference fuel volume flow through the pressure control valve. The reference fuel volume flow is sufficiently great that the pressure control valve allows setting of the pressure in the fuel accumulator.

A method for the adaptation of a pilot controller in a pressure regulating unit for a common rail injection system of an internal combustion engine is described in German Application No. DE 10 2005 058 966 B3. The regulating unit includes a pilot controller. The common rail injection system has at least one final control element settable by control signals, which each correspond to control values, for influencing the pressure. In the method, a pilot control value is ascertained to generate at least one control signal for the final control element and the instantaneous pressure is regulated to a predefined setpoint pressure while using the pilot control value by generating the at least one control signal and outputting it to the final control element. For the adaptation, the pilot controller is adapted as a function of at least one instantaneous value of an operating parameter of the internal combustion engine and a control value corresponding to the at least one control signal.

A method for controlling a direct injection internal combustion engine is described in German Application No. DE 100 16 900 C2. Accumulator pressure prevailing in a pressure accumulator of a fuel metering system of the internal combustion engine is regulated using an electrically activatable pressure control valve, via which fuel may be guided from the pressure accumulator into a low-pressure area of the fuel metering system to dissipate the accumulator pressure. It is provided that a pilot controller is connected upstream from the regulating unit of the accumulator pressure, an activation signal for the pressure control valve being ascertained within the scope of the pilot control as a function of the flow rate through the pressure control valve and the accumulator pressure, or the accumulator pressure resulting in the pressure accumulator being ascertained as a function of the flow rate through the pressure control valve and an activation signal for the pressure control valve.

An apparatus for advancing the start of injection of an internal combustion engine, for example, in the event of a cold start or low atmospheric pressure, is known from German Application No. DE 34 10 146 A1. This apparatus is controlled by a directional control valve, to which a relieved bypass line having an adjustable flow control valve is connected in parallel, the adjustability allowing a control of the start of adaptation of the pump characteristic curve to the characteristic curve of the internal combustion engine. In addition, a pressure control valve includes an outflow opening, which is controlled by its pressure control piston, the particular controlled flow rate cross section determining an adaptation of the pump characteristic curve to the characteristic curve of the internal combustion engine.

SUMMARY

Against this background, a method for determining a characteristic for a pressure regulating valve according to the present invention and a system for determining a characteristic for a pressure regulating valve according to the present invention are presented.

Using the method according to the present invention, for example, an adaptation function may be implemented, using which learning and/or correction of tolerances with respect to a characteristic of an opening pressure in at least one pressure regulating valve of an injection system, typically an accumulator injection system (common rail), is possible.

Using the method, an adaptation is typically carried out at flow rates of fuel through the pressure regulating valve at a minimum, for example, close to 0 L/h. OBD functionalities to carry out an onboard diagnosis in the motor vehicle, for example, monitoring the rail pressure sensor during ongoing operation, may thus be implemented. Furthermore, a behavior of the pressure regulating valve may be studied over its entire lifetime. In addition, it may result that sufficient quality of the pressure controller is also ensured during limp-home operation.

Using the method, it is possible in one exemplary embodiment to maintain a functionality of the pressure limiting. This is also possible, inter alia, for pressure regulating valves whose deenergized pressure characteristic via a flow rate through the pressure regulating valve is less than a permissible limiting value for the pressure. In addition, a suitable tolerance definition may be made with respect to the opening pressure characteristic, whereby a more precise pressure pilot control results.

For components of the injection system, together with a suitable error detection and/or error response, a smaller pressure design objective may thus be opted for, since the pressure regulating valve opens in case of error before reaching a permissible pressure. A gain in time for the error detection and/or error response or an implementation of a passive safeguard thus results.

In a possible implementation of the method according to the present invention, the case of error may also be taken into consideration, in which the pressure regulating valve is to be opened by a lower holding pressure level.

In another exemplary embodiment of the method, pressure regulating operation of the pressure regulating valve is not necessary for the adaptation, so that the fuel does not have to be heated unnecessarily. Overall, inter alia, a reduction in the fuel consumption thus results, since an adaptation phase may now be omitted in the case of a pump at full delivery.

Within the scope of the method, monitoring may also take place, offset errors and/or slope errors of a signal of a rail pressure sensor being detected. In this case, the rail pressure sensor is typically designed for the purpose of ascertaining a pressure of the fuel in a fuel accumulator (rail) of the injection system.

Depending on the provided overall concept with respect to the configuration and the functions of the injection system, different possible combinations with already existing monitoring functions are conceivable.

Furthermore, in the method, the adaptation typically takes place during regulated operation of the metering unit, whereby a frequency of the adaptations may be increased in comparison to the described adaptation functions.

In one exemplary embodiment of the method, in the case of operation of the metering unit during transient or temporary load shedding, e.g., during a shift procedure, a reduction of pressure overshoots may be achieved by precise holding pressure pilot control of the pressure regulating valve slightly above a pressure, typically a control pressure, provided for carrying out the method. A more favorable collective pressure load alternation may thus be achieved for components of the injection system.

Using the method, the pressure of the fuel during coasting, in the case of which no injections and therefore no quantity withdrawals from the fuel accumulator occur, is still regulated via the metering unit. For this purpose, within the scope of the method, a small leak is intentionally set by controlling the pressure and therefore the control pressure of the pressure regulating valve slightly below the opening pressure of the pressure regulating valve. The pressure (control pressure) is regulated in this case via a quantity regulation by the metering unit.

In the method, it is provided, inter alia, that a characteristic of the pressure regulating valve has a pressure gradient above the flow rate of the pressure regulating valve. As a function of the pressure gradient of the characteristic to be learned, which results above the flow rate of the pressure regulating valve, inter alia, an enlargement of the control range during coasting may be achieved, whereby smaller pressures are possible than during pressure-regulated operation. Since only small return quantities are required for the pressure regulating valve within the scope of the method, thermal efficiency of the system may be increased.

The system according to the present invention is designed for the purpose of carrying out all steps of the proposed method. Individual steps of this method may also be carried out by individual components of the system. Furthermore, functions of the system or functions of individual components of the system may be implemented as steps of the method. In addition, it is possible that steps of the method are implemented as functions of at least one component of the system or the entire system.

Further advantages and exemplary embodiments of the present invention are described in the following with reference to the accompanying drawings.

It is understood that the above-mentioned features and features to be explained hereafter are usable not only in the particular specified combination, but rather also in other combinations or alone, without departing from the scope of the present invention.

DETAILED DESCRIPTION

Figure 1:
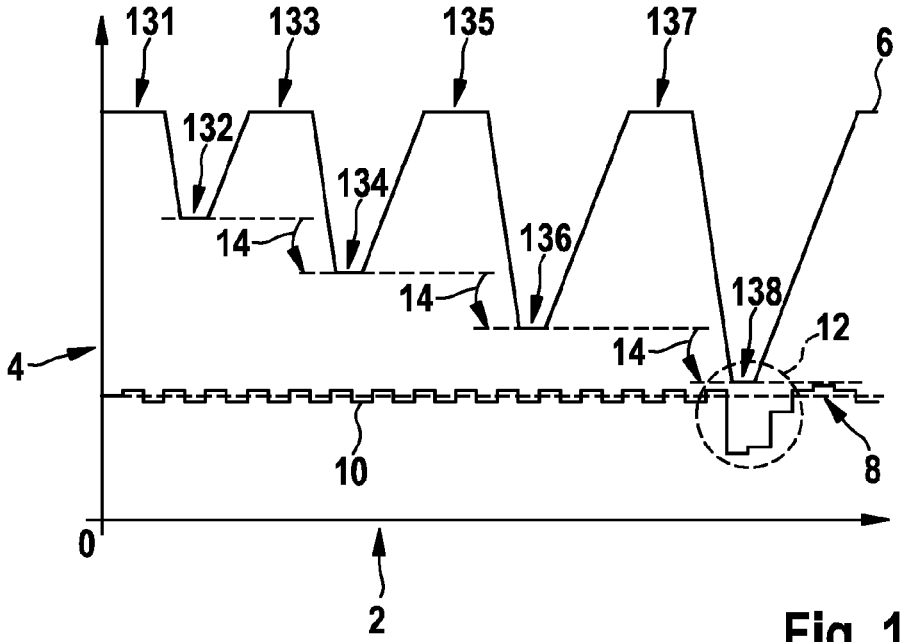
FIG. 1 shows a diagram of a first exemplary embodiment of a method according to the present invention.

The present invention is schematically shown on the basis of exemplary embodiments in the drawings and will be described in greater detail hereafter with reference to the drawings.

The figures are described cohesively and comprehensively; identical reference numerals identify identical components.

The diagram of FIG. 1 shows an abscissa 2, along which the time is plotted, and an ordinate 4, along which a pressure of a fuel in an injection system is plotted. Curves for a control pressure 6 of a pressure regulating valve, for a setpoint pressure 8 of the fuel, and for an actual pressure 10 of the fuel in the high-pressure accumulator, which is regulated via the metering unit, are plotted in the diagram. It is provided that an opening 12 of the pressure regulating valve takes place via a detection of an opening pressure by a quasi-pulsed reduction of control pressure 6 of the pressure regulating valve.

During stationary regulated operation of the metering unit at an arbitrarily high pressure level, a reduction of control pressure 6 of pressure regulating valve takes place until opening 12 of pressure regulating valve is detected. The way in which control pressure 6 is reduced and the opening point of pressure regulating valve is detected may be devised differently in the case of the particular instantaneous stationary pressure level.

Thus, the reduction of control pressure 6 may take place slowly and continuously. As the curve for control pressure 6 from the diagram in FIG. 1 shows, alternatively thereto, ramps having different slopes or a dropping and rising control pressure 6 may be provided, the level of the lowest control pressure 6 being reduced step-by-step by multiple pressure intervals 14 until opening 12 is detected.

In this case, the control pressure alternately passes through higher pressure plateaus k 131, k+2 133, k+4 135, k+6 137 and lower pressure plateaus k+1 132, k+3 134, k+5 136, and k+7 138. Higher pressure plateaus k 131, k+2 133, k+4 135, and k+6 137 have the same value for the control pressure. A level of lower pressure plateaus k+1 132, k+3 134, k+5 136, and k+7 138 is decreased in each case by pressure intervals 14.

Opening 12 of the pressure regulating valve upon reaching k+7th low pressure plateau 138 is recognizable by a noticeable change in actual pressure 10; a strong deflection of actual pressure 10 takes place in this case.

The detection of opening 12 of the pressure regulating valve takes place here in the event of an increase in a value of a controller output of the metering unit, typically in the event of an elevated quantity request upon the presence of a leak.

Alternatively, as the diagram in FIG. 1 shows, a drop of actual pressure 10 or an increase of the regulating deviation may be used for detecting opening 12. Due to the hot fuel in the return line of the injection system, opening 12 of the pressure regulating valve may also be detected on the basis of an increase in the temperature of a coil of the pressure regulating valve. This may take place, for example, directly via a temperature sensor or indirectly via an increase in the resistance of the coil of the pressure regulating valve. Alternatively or additionally, opening 12 may also be detected indirectly via a current regulator output. This may occur via an increase of the duty factor at constant current due to a temperature-related increase in the resistance.

Depending on the instantaneous value of the stationary pressure, an adaptation of a characteristic curve as the characteristic is carried out over the entire range of setpoint pressure 10 of the system. Values for the provided adaptation result from the difference between a nominal value or setpoint value of the opening pressure of the pressure regulating valve as a reference value and the ascertained opening pressure of the pressure regulating valve. The values obtained during this adaptation may subsequently be used for normal driving operation.

Figure 2:
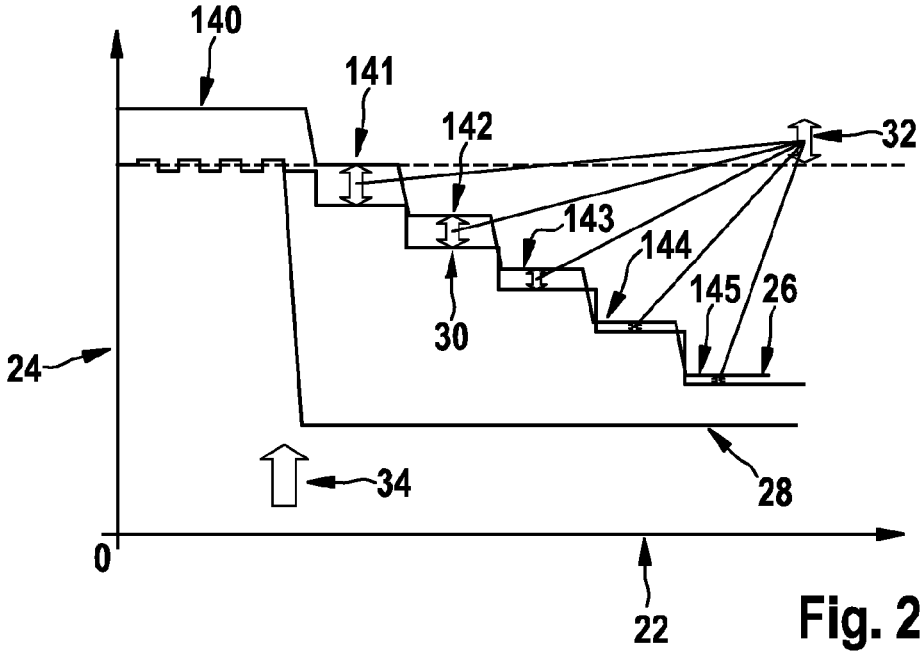
FIG. 2 shows a diagram of a second exemplary embodiment of the method according to the present invention.

The diagram in FIG. 2 also includes an abscissa 22, along which the time is plotted, and an ordinate 24, along which the pressure is plotted. A curve for a control pressure 26 of the pressure regulating valve, a curve for setpoint pressure 28, and a curve for actual pressure 30 of the fuel in the high-pressure accumulator are shown in the diagram. Double arrows 32 between the curve for control pressure 26 and the curve for actual pressure 30 identify deviations of control pressure 26 from actual pressure 30 as a function of control pressure 26. In addition, a coasting transition of setpoint pressure 28 is indicated by a single arrow 34.

In the second exemplary embodiment of the method according to the present invention, which is described on the basis of the diagram in FIG. 2, a stepped decrease and therefore a reduction of control pressure 26 takes place during coasting phases to learn a broad pressure range. Control pressure 26 passes through multiple pressure plateaus 140, 141, 142, 143, 144, 145, whose level decreases in the chronological progression of the method.

This second exemplary embodiment of the method is typically suitable for injection systems without leaks. In this case, long coasting phases or coasting transitions and/or also transient shift procedures, if the adaptation may be carried out sufficiently rapidly, may be used to detect an opening of a pressure regulating valve and to determine a prevailing pressure, i.e., control pressure 26 of the fuel. During transient shift procedures, which may typically be linked to negative setpoint pressure gradients, the control value of the pressure regulating valve may be frozen at an enlarged value in relation to its target value at a stationary level 140, 141, 142, 143, 144, 145. In such a coasting phase, a pressure plateau 140, 141, 142, 143, 144, 145 is thus formed. In this case, a pump of an injection system is closed and no injection takes place.

The adaptation value results from a difference between a value of control pressure 26 upon the opening of the pressure regulating valve, as a function here of the level of pressure plateau 140, 141, 142, 143, 144, 145, and setpoint pressure 30 as the reference value when the pressure regulating valve opens. Furthermore, the level of pressure plateau 140, 141, 142, 143, 144, 145 may be continuously increased from shift procedure to shift procedure up to the nominal pressure. A reverse sequence of the adaptation is only provided, due to possible pressure peaks during the shift procedure, when the learning information is already present at a nominal pressure, as is provided, for example, in the first exemplary embodiment of the method. Furthermore, it is provided in this case that pressure peaks are tolerable or may be avoided in another way.

During long coasting phases, in which the pump is closed and no injections take place, ideally if the learning value for the nominal pressure is available, control pressure 26 of the pressure regulating valve may be reduced step-by-step while passing through pressure plateaus 140, 141, 142, 143, 144, 145, so that the overall pressure characteristic for the opening of the pressure regulating valve may be ascertained starting from the nominal pressure up to minimal control pressure 26 of particular stationary control pressures 26 and associated pressure plateaus 140, 141, 142, 143, 144, 145.

In the second exemplary embodiment of the method, setpoint pressure 28 is less than the minimal opening pressure of the pressure regulating valve, since the pump could otherwise be opened again by the pressure regulating valve. In this case, it is also possible to keep the pump closed intentionally for the duration of the adaptation during coasting. In the second exemplary embodiment of the method, an adaptation of the characteristic curve takes place as in the first exemplary embodiment.

Figure 3:
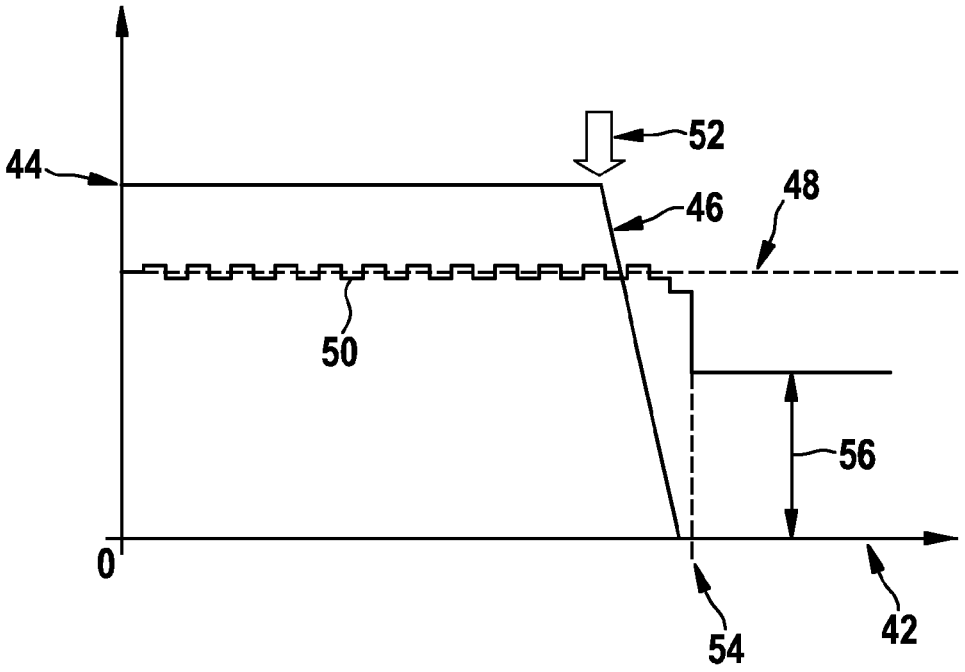
FIG. 3 shows a diagram of a third exemplary embodiment of the method according to the present invention.

The diagram from FIG. 3 of a third exemplary embodiment of the method according to the present invention includes an abscissa 42, along which the time is plotted, and an ordinate 44, along which the pressure of a fuel to be injected is plotted. In the diagram, a first curve represents a control pressure 46 of the pressure regulating valve and a second curve represents a regulated actual pressure 50 through the metering unit. A straight line indicates a setpoint pressure 48 during idling. A point in time for a shutdown of the engine is indicated by arrow 52. The output stage of the pressure regulating valve is deactivated as soon as control pressure 46 of the pressure regulating valve has reached the value zero. The pressure regulating valve opens in the event of a visible pressure drop at point in time 54. A mechanical-hydraulic holding pressure of the pressure regulating valve is indicated by double arrow 56. At this mechanical-hydraulic holding pressure, the pressure regulating valve is closed in a stationary way.

As the diagram from FIG. 3 shows, after the shutdown of the engine and deenergizing of the pressure regulating valve, a pressure equilibrium is set between the mechanical holding force of the pressure regulating valve, which acts in a closing way, and the hydraulic pressure in the injection accumulator (rail).

In the third exemplary embodiment of the method according to the present invention, only the deenergized opening pressure of the pressure regulating valve, having a deenergized holding pressure which is greater than zero bar and less than the pressure of the injection system, is determined via a point adaptation. The mechanical tolerance of such pressure regulating valves is typically very small in this regard, since it is a function of relatively few factors, for example, a spring pre-tension force and/or a seat diameter. This is particularly advantageous for the plausibility check of the rail pressure sensor.

If the deenergized opening pressure is less than the idle pressure, as the diagram from FIG. 3 shows, the resulting pressure level after shutdown of the engine may be compared to the nominal pressure level or level of the setpoint pressure and adapted.

In contrast, if the deenergized opening pressure is greater than the idle pressure, this opening pressure, similarly as in the second exemplary embodiment of the method, may be ascertained by a shutdown of the output stage, i.e., at minimal control pressure 46, during coasting. Control pressure 46 drops during the shift procedure in this case to a minimum possible pressure or until a targeted pressure plateau is set, at which the pressure regulating valve is opened. It is provided that setpoint pressure 48 is less than the minimal opening pressure, since otherwise the pump is reopened by the controller.

Figure 4:
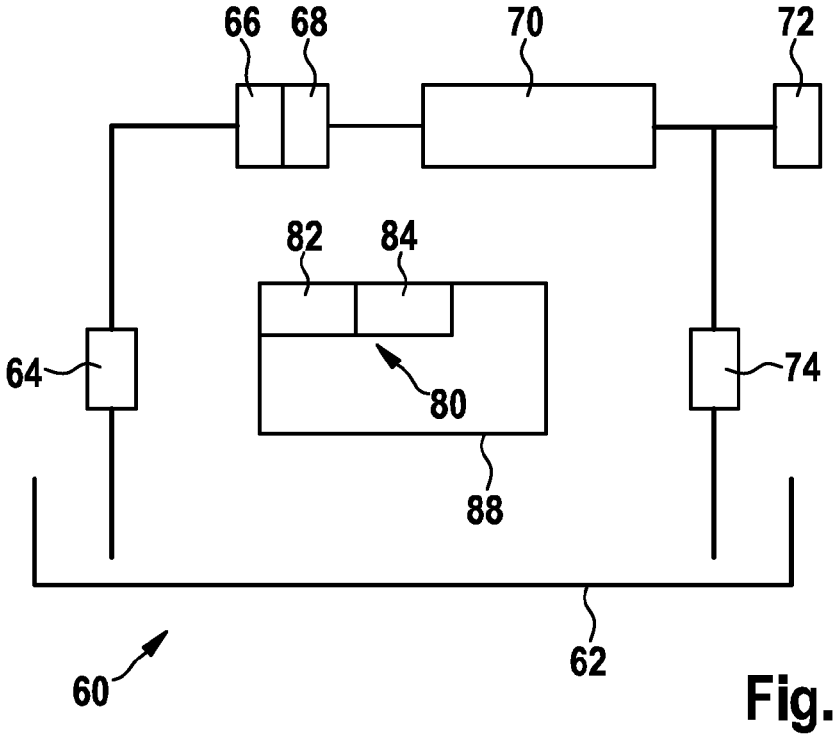
FIG. 4 shows a schematic view of one exemplary embodiment of a system according to the present invention.

FIG. 4 shows a schematic illustration of an injection system 60, which is designed as an accumulator injection system, for injecting fuel into an internal combustion engine according to the common rail or accumulator injection method. This injection system 60 includes a reservoir 62 for the fuel, a low-pressure pump 64 for conveying fuel from reservoir 62, a metering unit 66, and a high-pressure pump 68. This high-pressure pump 68 is designed for the purpose of building up and maintaining a pressure of the fuel within a high-pressure accumulator 70. Fuel from high-pressure accumulator 70 is injected into combustion chambers to operate the internal combustion engine. In addition, injection system 60 includes a rail pressure sensor 72 and a pressure regulating valve 74, via which fuel may be discharged into reservoir 62 in the event of overpressure.

A system 80 according to the present invention in FIG. 4 includes two modules 82, 84 here, which are designed as components of a control unit 88. Control unit 88 is also designed here for the purpose of monitoring, controlling and/or regulating functions of individual components of injection system 60 for operating injection system 60 independently of carrying out the method according to the present invention.

It is provided here that a first module 82 is designed to regulate operating parameters. First module 82 sets a flow of the fuel which flows through pressure regulating valve 74 to a minimum and reduces a control pressure of the fuel until pressure regulating valve 74 is opened. Values of operating parameters to determine the characteristic to be ascertained are acquired using a second module 84. Second module 84 forms a value for the characteristic and therefore typically an adaptation value from a difference between a value for the control pressure, at which pressure regulating valve 74 opens, and a reference value for the control pressure. In addition, second module 84 is designed for the purpose of adapting the characteristic.

The reference value of the control pressure is generally a setpoint value or a nominal value which is a function of an operating point of injection system 60 and/or the internal combustion engine.

What is claimed is:

1. A method for determining a characteristic for a pressure regulating valve of an injection system, using which fuel is injected into an internal combustion engine, comprising:

setting a flow of the fuel which flows through the pressure regulating valve to a minimum;

reducing a control pressure of the fuel until the pressure regulating valve is opened; and forming at least one value for the characteristic from a difference between a value for the control pressure, at which the pressure regulating valve opens, and a reference value for the control pressure.

2. The method according to claim 1, wherein the flow of the fuel is reduced to zero.

3. The method according to claim 1, wherein the control pressure undergoes a ramped reduction, the control pressure passing through multiple pressure plateaus, the control pressure proceeding from a kth high pressure plateau, being reduced to a k+1st low pressure plateau, being increased to a k+2nd high pressure plateau, and being then reduced to a k+3rd low pressure plateau, which is lower than the k+1st low pressure plateau.

4. The method according to claim 1, wherein the control pressure is reduced continuously.

5. The method according to claim 1, wherein the control pressure is reduced step-by-step, the control pressure passing through multiple pressure plateaus.

6. The method according to claim 1, wherein an actual pressure to be reduced by the control pressure is greater than a setpoint pressure of the fuel.

7. The method according to claim 1, wherein opening of the pressure regulating valve is detected by raising a coil temperature of the pressure regulating valve or via a flow rate sensor.

8. The method according to claim 1, wherein the method is carried out during at least one of a shift procedure and a coasting phase of the internal combustion engine.

9. A system for determining a characteristic for a pressure regulating valve of an injection system, using which fuel is injected into an internal combustion engine, comprising:

a plurality of modules, at least one module being configured to set a flow of the fuel which flows through the pressure regulating valve to a minimum, to reduce a control pressure of the fuel until the pressure regulating valve is opened, and to form at least one value for the characteristic from a difference between a value for the control pressure, at which the pressure regulating valve opens, and a reference value for the control pressure.

10. The system according to claim 9, wherein the at least one module is configured to adapt the characteristic.

* * * * *